US010653216B2

(12) United States Patent
Ambrose

(10) Patent No.: US 10,653,216 B2
(45) **Date of Patent: *May 19, 2020**

(54) CUSTOMISABLE JEWELLERY

(71) Applicant: Nicholas Lieth Ambrose, Colchester (GB)

(72) Inventor: Nicholas Lieth Ambrose, Colchester (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/412,243

(22) Filed: May 14, 2019

(65) Prior Publication Data

US 2019/0261748 A1 Aug. 29, 2019

Related U.S. Application Data

(63) Continuation of application No. 15/561,496, filed as application No. PCT/GB2016/050809 on Mar. 23, 2016, now Pat. No. 10,334,918.

(30) Foreign Application Priority Data

Mar. 26, 2015 (GB) ..... 1505111.3
Mar. 2, 2016 (GB) ..... 1603639.4

(51) Int. Cl.
*A44C 17/02* (2006.01)

(52) U.S. Cl.
CPC ..... *A44C 17/0225* (2013.01)

(58) Field of Classification Search
CPC ..... A44C 7/002; A44C 9/00; A44C 9/0053; A44C 9/0061; A44C 17/0208; A44C 17/0216; A44C 17/0225; A44C 27/00; A44C 15/00; Y10T 29/4959
USPC ..... 63/15, 28, 29.1, 40, 23, 35
See application file for complete search history.

(56) References Cited

U.S. PATENT DOCUMENTS

| | | | |
|---|---|---|---|
| 1,827,607 | A | 10/1931 | Pfaffinger |
| 3,255,611 | A | 6/1966 | Doherty |
| 3,336,697 | A | 8/1967 | Davis |
| 4,448,304 | A | 5/1984 | Weinzettel et al. |
| 4,907,704 | A | 3/1990 | Souders |
| 4,982,580 | A | 1/1991 | Otenbaker |
| 4,996,545 | A | 2/1991 | Enomoto et al. |
| 5,806,345 | A | 9/1998 | Boncheck |
| 7,036,339 | B1 | 5/2006 | Chia et al. |
| 2003/0014996 | A1 | 1/2003 | Feuer |

(Continued)

FOREIGN PATENT DOCUMENTS

| | | | |
|---|---|---|---|
| AU | 2013100150 | A4 | 3/2013 |
| GB | 2475109 | A | 5/2011 |

(Continued)

OTHER PUBLICATIONS

International Search Report (International Application No. PCT/GB2016/050809); dated Aug. 8, 2016; 2 pages.

(Continued)

*Primary Examiner* — Jack W Lavinder
(74) *Attorney, Agent, or Firm* — Howard & Howard Attorneys PLLC

(57) ABSTRACT

A customisable item of jewellery comprises a grid with a plurality of openings defining a plurality of distinct closely contiguous adornment locations, and attachment means suitable for releasably retaining a pin of an adornment in each selected one of the plurality of openings, whereby once a plurality of adornments are attached to the attachment means, a cluster of releasable adornments is formed.

8 Claims, 13 Drawing Sheets

(56) References Cited

U.S. PATENT DOCUMENTS

| | | | |
|---|---|---|---|
| 2006/0007668 | A1 | 1/2006 | Chien |
| 2007/0094776 | A1 | 5/2007 | Stevens et al. |
| 2008/0155788 | A1 | 7/2008 | Wilcox |
| 2010/0011623 | A1 | 1/2010 | Seckler et al. |
| 2010/0031547 | A1 | 2/2010 | Howell |
| 2010/0257897 | A1 | 10/2010 | Kohl |
| 2011/0132036 | A1 | 6/2011 | Meltzer |
| 2012/0045597 | A1 | 2/2012 | Ponce |
| 2012/0118317 | A1 | 5/2012 | Payne |
| 2013/0042391 | A1 | 2/2013 | Hill et al. |
| 2014/0147614 | A1 | 5/2014 | Taylor |
| 2014/0352857 | A1 | 12/2014 | Warren |

FOREIGN PATENT DOCUMENTS

| | | | |
|---|---|---|---|
| JP | 2006309099 | A | 11/2006 |
| KR | 20050107350 | A | 11/2005 |
| WO | 88/10162 | A1 | 12/1988 |

OTHER PUBLICATIONS

International Preliminary Report on Patentability (International Application No. PCT/GB2016/050809); dated Mar. 14, 2017; 14 pages.

CUSTOMISABLE JEWELLERY

CROSS-REFERENCE TO RELATED APPLICATION

This application is a continuation of U.S. patent application Ser. No. 15/561,496, filed on Sep. 25, 2017, which is a U.S. National Phase of International Application No. PCT/GB2016/050809, filed on Mar. 23, 2016, which claims the priority to United Kingdom Patent Application No. 1603639.4, filed on Mar. 2, 2016, which claims the priority to United Kingdom Patent Application No. 1505111.3, filed on Mar. 26, 2015, including the specification, claims, and drawings, the entire disclosures of which are incorporated by reference herein.

FIELD OF THE INVENTION

The invention relates to a customisable item of jewellery, which may be provided in combination with a plurality of adornments.

BACKGROUND OF THE INVENTION

Items of jewellery are often mass-produced to a particular design as chosen by the jewellery manufacturer in question. However, these mass-produced items are not unique, and the designs used for these items may not be to everyone's taste. As an alternative to mass-production, one-off items of jewellery may be commissioned, or else may be hand-made, by individuals wanting something unique. However, commissioned items can be expensive to buy and hand-made items can be difficult for non-skilled individuals to assemble. Furthermore, jewellery items are often produced by temporarily melting or softening metallic or plastic materials, but this can be a messy and time-consuming process, and the resultant jewellery items cannot easily be altered once they have been assembled.

In the prior art:

JP2006309099 (YASUO) shows a spectacle frame having a pipe hole within which accessories such as earrings can be inserted;

US2010/031547 (HOWELL) provides an ID card holder with holding one or more configured charms;

US2010/011623 (SECKLER ET AL) provides a flip-flop with a single fastening member to attach a single ornament;

US2014/352857 (WARREN) provides an ornamentation system in which one or more jewels can be connected to a setting which can subsequently be attached to an accessory such as a purse or handbag;

US2011/0132036 (MELTZER) provides a mounting to display ornamental beads on an item of jewellery;

US2008/0155788 (WILCOX) provides a charm and fastening system for connecting charms to items of clothing or to collars of animals;

US2006/007668 (CHEIN) provides a system of attachment of LED decorative elements to footwear;

US2013/042391 (HILL) provides a adornment which can be attached and detached from a fashion item and wherein the adornment has a base which can be detachably fastened to further ornaments;

US2012/118317 (PAYNE) provides an accessory system where a user can attach at least one embellishment which is interchangeable to a base accessory by a fastening component and;

AU2013100150 (BUDINGER) provides a badge assembly that can be fastened to two or more stud assemblies.

SUMMARY OF THE INVENTION

In a first broad independent aspect, the invention provides a customisable item of jewellery comprising a grid with a plurality of openings defining a plurality of distinct closely contiguous adornment locations, and attachment means suitable for releasably retaining a pin of an adornment in each selected one of the plurality of openings; whereby once a plurality of adornments are attached to the attachment means, a cluster of releasable adornments is formed.

This configuration is advantageous because it allows a user to easily and efficiently customise their jewellery item to their personal choosing without the need for a professional jeweller. This means multiple different designs can be obtained from the same jewellery item by using the grid as an interconnecting web to which various adornment scan be easily added. Items of jewellery can be both valuable, fragile and sentimental and it is therefore of a great advantage that, whilst being releasable, the adornments can be secured by the attachment means to prevent both loss and damage. The opening provide pre-determined spaces through which the adornments can be held and spaced. The arrangement may therefore be particularly tough and withstand a wide variety of dislodgement forces which can arise in certain circumstance of ordinary wear.

In a subsidiary aspect, the attachment means comprises a layer of resilient material which is provided beneath the grid and which spans a plurality of the openings; whereby the layer of resilient material is positioned to receive a pin of an adornment; the pin being retained by frictional contact between the pin and the resilient material when the pin is inserted into the resilient material.

This configuration is particularly advantageous because it provides a means of retaining the adornment in the grid whilst minimising the potential for damage and without the need for the user to take the item to a professional jeweller for exchange of adornments. The use of this material provides a retaining means which is both secure enough to retain the pin of the adornment in a way which stops unnecessary movement which could cause damage and which has a sufficient degree of flexibility to allow effortless insertion and removal of the pins of the adornments.

In a further subsidiary aspect, the item comprises an upstanding peripheral wall that substantially surrounds the grid where the plurality of adornment locations are provided.

The configuration is particularly advantageous because it provides a secure surrounding to the adornments and adds a layer of protection which can stop them from sliding and falling out of the grid if they are to be knocked. This provides an extra layer of protection which will keep the adornments stable without removing any aesthetic appeal.

In a further subsidiary aspect, the wall comprises a recessed channel located on the inside surface of the wall for receiving the grid.

This configuration is particularly advantageous because it provides a simple method for connection of the grid to the inner wall. This means that a grid can be replaced if necessary, due to damage or otherwise, allowing the user to keep the same wall setting. A recessed channel is particularly secure by preventing the grid from being lifted upwards or pushed downwards when the adornments are inserted or removed and ensure it remains in place at all times, particularly whilst the item is being worn.

In a further subsidiary aspect, the wall comprises one or more flanges for carrying the grid.

This configuration is particularly advantageous because a flange will provide extra strength to retain the grid in place when an adornment is either inserted or removed from the grid.

In a further subsidiary aspect, the item further comprises a plurality of adornments which incorporate a head, and a pin projecting from the head for releasable attachment to the attachment means.

This configuration is particularly advantageous because it provides a model of producing an item of jewellery that can be varied in design as and when the owner chooses. The adornments can be inserted below into the grid so that the projecting pin is out of sight and the head remains visible. The pin allows for insertion and retention into the grid in a non-permanent manner such that the adornments can be easily released to exchange with an alternative adornment.

In a further subsidiary aspect, the pin comprises a barb.

This configuration is particularly advantageous because it provides a sharp point to ease the entry of the adornment through both the grid and the rubber material and ensures that the adornment will remain in place once it is through the rubber material, unless a force is applied. This barb also adds a level of protection to prevent the adornment from being released unintentionally, whilst the item is being worn.

In a further subsidiary aspect, the resilient material comprises a viscoelastic material.

This configuration is particularly advantageous because it is an ideal material to provide enough friction that the adornment remains secure within the layer as the pin is gripped and will not therefore fallout due to its own weight, which could be considerable bearing in mind the weight of the decorative element The material also provides enough flexibility that the adornments can be inserted and removed with ease by the jewellery owner, without the need of a professional jeweller or by a strenuous or laborious method of the type that can usually be required for jewellery alterations and stone replacements.

In a further subsidiary aspect, the item comprises a plurality of grids which are located at different heights relative to the lower most extremity of the item.

This configuration is particularly advantageous because it provides different levels in which the adornments can be inserted and adds an element of depth to the jewellery item which can be not only more aesthetically desirable than a purely flat face but provide a more robust overall structure.

In a further subsidiary aspect, the grid is domed.

This configuration is particularly advantageous because it also adds an element of depth to the item of jewellery which can be desired, particularly for pieces of jewellery such as earrings and rings.

In a further broad independent aspect, the invention provides a customisable item of jewellery comprising a plurality of adornment locations, each of the adornment locations having attachment means for receiving and retaining a pin of an adornment.

In a subsidiary aspect, the attachment means releasably retains the pin.

In a further subsidiary aspect, the attachment means comprises mechanical and/or magnetic attachment means.

In a further subsidiary aspect, the attachment means retains the pin by way of: a friction fit; an interference fit; a press fit; a snap fit; a screw fit; a catch; and/or a magnet.

In a further subsidiary aspect, the attachment means retains the pin by friction.

In a further subsidiary aspect, the attachment means comprises resilient material, the pin being retained by frictional contact between the pin and the resilient material when the pin is inserted into the resilient material.

In a further subsidiary aspect, the resilient material comprises a polymer material.

In a further subsidiary aspect, the resilient material comprises a viscoelastic material.

In a further subsidiary aspect, the item further comprises an upper grille having a plurality of openings that respectively define the adornment locations.

In a further subsidiary aspect, the shapes of the openings tessellate with one another.

In a further subsidiary aspect, the shapes of the openings are the same as one another.

In a further subsidiary aspect, the shape of each opening is: substantially circular; substantially triangular; substantially square; substantially pentagonal; or substantially hexagonal.

In a subsidiary aspect, the item may incorporate one or more heart shaped openings, flower shape openings and elliptical petal shape openings.

In a further embodiment, the outer wall may itself have a heart shape, a flower shape, a skull shape, or a cross shape.

In a further subsidiary aspect, the item comprises an upstanding peripheral wall that substantially surrounds the plurality of adornment locations.

In a further subsidiary aspect, the item is: a ring; an earring; a neckless; a pendant; a bracelet; an anklet; an armlet; a cufflink; an item of body piercing jewellery; an item of decorative headgear; a hair accessory; watch; watch strap or a brooch.

In a further independent aspect, the invention provides a customisable item of substantially as hereinbefore described with reference to the accompanying figures.

In a further subsidiary aspect, the invention provides a customisable item of of the preceding aspects in combination with a plurality of adornments for inserting into the item.

In a further subsidiary aspect, the item comprises a plurality of adornment locations, each of the adornment locations having attachment means for receiving and retaining a projecting part of an adornment.

In a further subsidiary aspect, the attachment means releasably retains the projecting part.

In a further subsidiary aspect, the projecting part comprises one or more elongate members.

In a further subsidiary aspect, the attachment means comprises mechanical and/or magnetic attachment means.

In a further subsidiary aspect, the attachment means retains the projecting part by way of: a friction fit; an interference fit; a press fit; a snap fit a screw fit; a catch; and/or a magnet.

In a further subsidiary aspect, the attachment means retains the projecting part by friction.

In a further subsidiary aspect, the attachment means comprises resilient material, the projecting part being retained by frictional contact between the projecting part and the resilient material when the projecting part is inserted into the resilient material.

In a further subsidiary aspect, the resilient material comprises a polymer material.

In a further subsidiary aspect, the resilient material comprises a viscoelastic material. In an alternative embodiment, the resilient material comprises a metal.

In a further subsidiary aspect, the item further comprises one or more upper grilles each having a plurality of openings that respectively define the adornment locations.

In a further subsidiary aspect, the shapes of the openings tessellate with one another.

In a further subsidiary aspect, the shapes of the openings are the same as one another.

In a further subsidiary aspect, the shape of each opening is: substantially circular, substantially triangular; substantially square; substantially pentagonal; or substantially hexagonal.

In a further subsidiary aspect, the item comprises a peripheral wall that substantially surrounds the plurality of adornment locations.

In a further subsidiary aspect, the item is: a ring; an earring; a neckless; a pendant; a bracelet; an anklet; an armlet; a cufflink; a watch; a tie pin or tie clip; an item of body piercing jewellery; an item of decorative headgear; a hair accessory; or a brooch.

Thus, according to an aspect of the present invention there is provided a customisable item of jewellery comprising a plurality of adornment locations, each of the adornment locations having attachment means for receiving and retaining a pin of an adornment.

As will be appreciated, the present invention can provide a unique item of jewellery that can easily be customised by the non-skilled individual. In particular, the item of jewellery may be assembled simply by inserting or pushing the free ends of pins of selected adornments into the attachment means at respective adornment locations, for example so as to build up a unique pattern of adornments.

The attachment means preferably axially receives and/or axially retains the pin of the adornment. As is will be appreciated, the axis in question here is the longitudinal axis of the pin. The attachment means also preferably retains the pin laterally, preferably so as to prevent the adornment from being displaced sideways. In particularly preferred embodiments, the attachment means releasably retains the pin, preferably such that the pin can later be removed in the axial direction. These embodiments provide a jewellery item that can be easily assembled and/or repeatedly altered by the non-skilled individual. As will be appreciated, the technique or force required to remove the pin is preferably such that the adornment will not fall out of the item under its own weight.

In preferred embodiments, the attachment means comprises mechanical and/or magnetic attachment means. For example, the attachment means may retain the pin by way of: a fiction fit, an interference fit, a press fit, a snap fit, a screw fit; a catch; and/or a magnet. The shaft of the pin may comprise projections and/or indentations that increase the amount of friction, or that provide a back-locking effect between the pin and the attachment means. In particularly preferred embodiments, the attachment means retains the pin by fiction, and preferably by friction alone. For example, the attachment means may comprise bulky resilient material, the pin being retained by fictional contact between the pin and the resilient material when the pin is inserted into the resilient material. The resilient material may comprise a polymer material and/or a viscoelastic material. For example, the resilient material may comprise an elastomer, such as natural rubber or synthetic rubber. These embodiments have been identified as being low cost and simple to manufacture, as well as being particularly easy for the non-skilled individual to customise.

In preferred embodiments, the item of further comprises an upper grille having a plurality of openings that respectively define the adornment locations. The openings are preferably each arranged so as to receive a pin of an adornment. The upper grille may be provided adjacent to (e.g. above or on) the above-mentioned resilient material. The upper grille may comprise, for example, metallic or plastic material. The shapes of the openings in the upper grille may tessellate with one another and/or may be the same as one another. The shape of each opening may be substantially circular; substantially triangular; substantially square; substantially pentagonal; or substantially hexagonal. These embodiments can assist in locating the adornments and/or spacing the adornments suitably from one another.

In preferred embodiments, the item of comprises an upstanding peripheral wall that substantially surrounds the plurality of adornment locations. This wall may protect the adornments from damage and/or may prevent the adornments from being displaced.

The item of jewellery may take any desired or suitable form. For example, the item may be: a ring an earring a neckless; a pendant; a bracelet; an anklet; an armlet; a cufflink; an item of body piercing jewellery; an item of decorative headgear (e.g. a tiara); a hair accessory (e.g. a hair dip or hair band); or a brooch. The main or "non-customisable" body of the item of jewellery may comprise, for example, (precious or semi-precious) metallic material or plastic material.

In preferred embodiments, the item is a ring comprising a band for receiving a finger or toe. A customisable region comprising the plurality of adornment locations is preferably attached to the band.

In some embodiments, the item of jewellery may be provided separately from a plurality of adornments for inserting into the item. In other embodiments, the item of jewellery may be provided in combination with a plurality of adornments for inserting into the item. Each adornment preferably comprises a decorative element attached to one end of a pin, with the other (free) end of the pin being received by the attachment means. The decorative element may comprise metallic material, plastic material, and/or one or more jewels, gemstones, sequins, etc. The decorative element may be precious or semiprecious, or may be an imitation of a precious or semi-precious decorative element.

BRIEF DESCRIPTION OF THE DRAWINGS

By way of example only, an embodiment of the invention will now be described in detail with reference being made to the accompanying drawings in which.

DETAILED DESCRIPTION OF INVENTION

Figure 1:
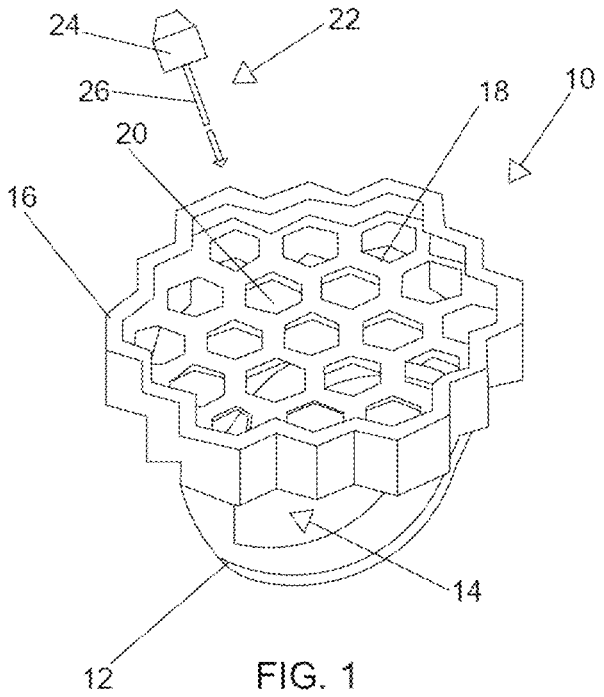
FIG. 1 is a perspective view of an item of jewellery according to an embodiment of the present invention.
Figure 2:
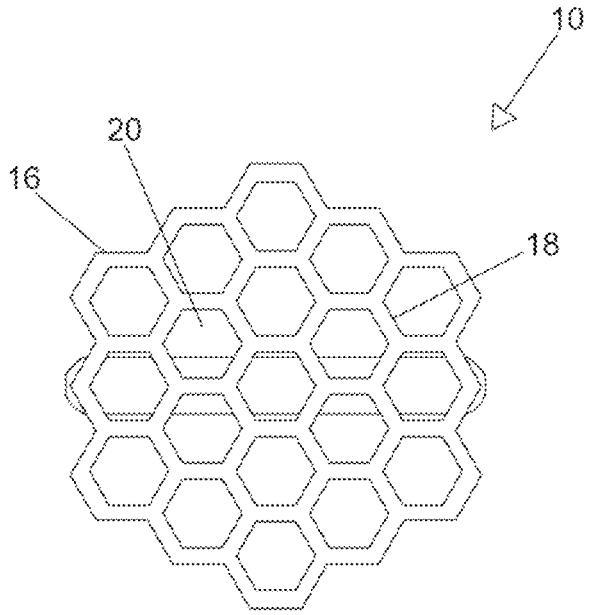
FIG. 2 is a plan view of the item of jewellery of FIG. 1.
Figure 3:
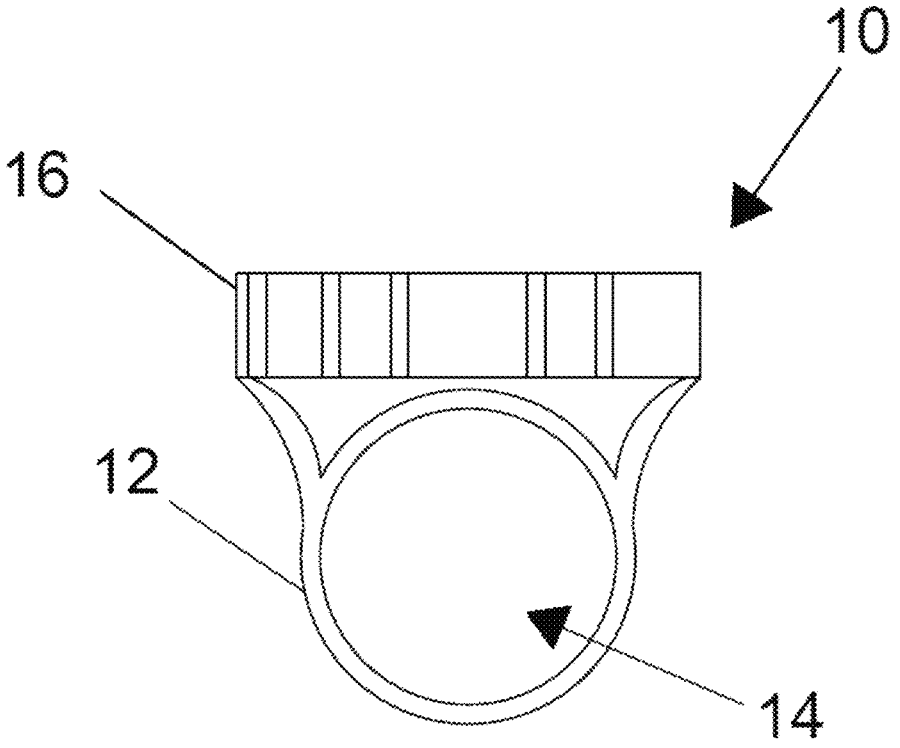
FIG. 3 is a first side view of the item of jewellery of FIG. 1.
Figure 4:
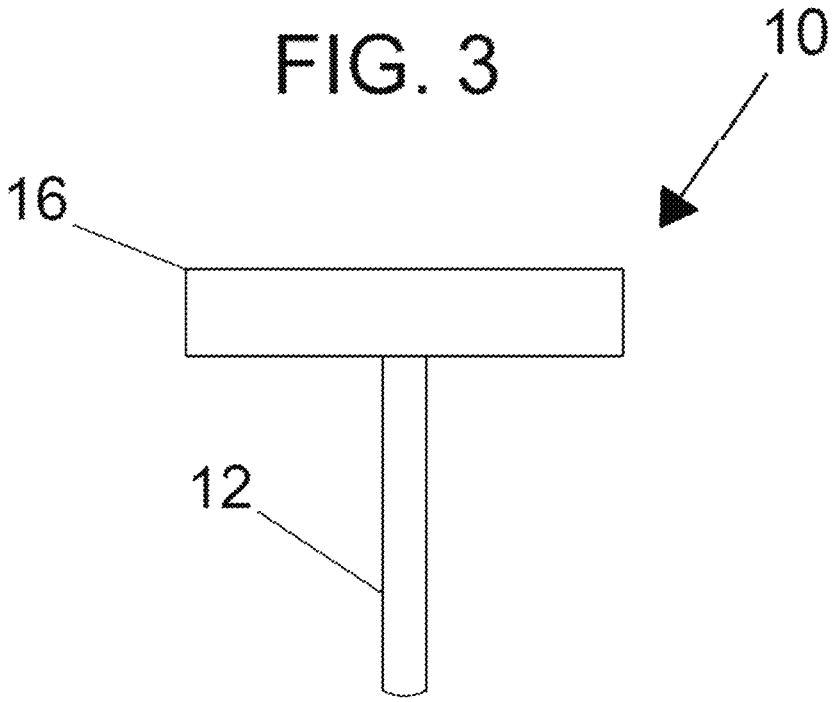
FIG. 4 is a second side view of the item of jewellery of FIG. 1.

The Figures show various views of a customisable item of jewellery. FIGS. 1-4 show the item in the form of a ring 10. The ring 10 comprises a metallic band 12 that defines an opening 14 for receiving a finger. The ring 10 further comprises a customisable region surrounded by an upstanding peripheral metallic wall 16. Within the wall 16 is a metallic plate in the form of a grid 18, hereafter referred to as an "upper grille" 18 that provides a plurality of tessellating hexagonal openings 20. In this way, metallic upper grille 18 and openings 20 form an interconnecting web lattice.

For the sake of clarity, only one of the openings 20 is indicated in the Figures. The openings 20 each define a location for respectively receiving an adornment 22. Only one exemplary adornment 22 is shown in FIG. 1, but it will be appreciated that several similar adornments would be provided in order to assemble the item of jewellery fully (FIGS. 9A-9C). In this embodiment, each adornment 22 comprises a decorative element 24 in the form of a semi-precious jewel, which is attached to an end of a pin 26. The other free end of the pin 26 is inserted through an opening 20 in the direction of the arrow. Just below the upper grille 18 there is provided a block of rubber material 28 (FIGS. 5-8) that axially receives the pin 26 of the adornment 22 and releasably retains the pin 26 by friction alone. The ring 10 can be customised by pushing the pins 26 of several other adornments 22 through the openings 20 into the rubber material 28. The resilience and viscoelasticity of the rubber material 28 ensures that the appearance of the ring 10 can be repeatedly altered by removing and changing or relocating the adornments 22.

The rubber material 28 is shown clearly in FIGS. 5 to 8. The nature of the rubber material allows the pins 26 to be held securely in place by friction, without movement. However it is flexible enough that the pins can be easily inserted and removed by the consumer and without the need of a professional jeweller.

Figure 5:
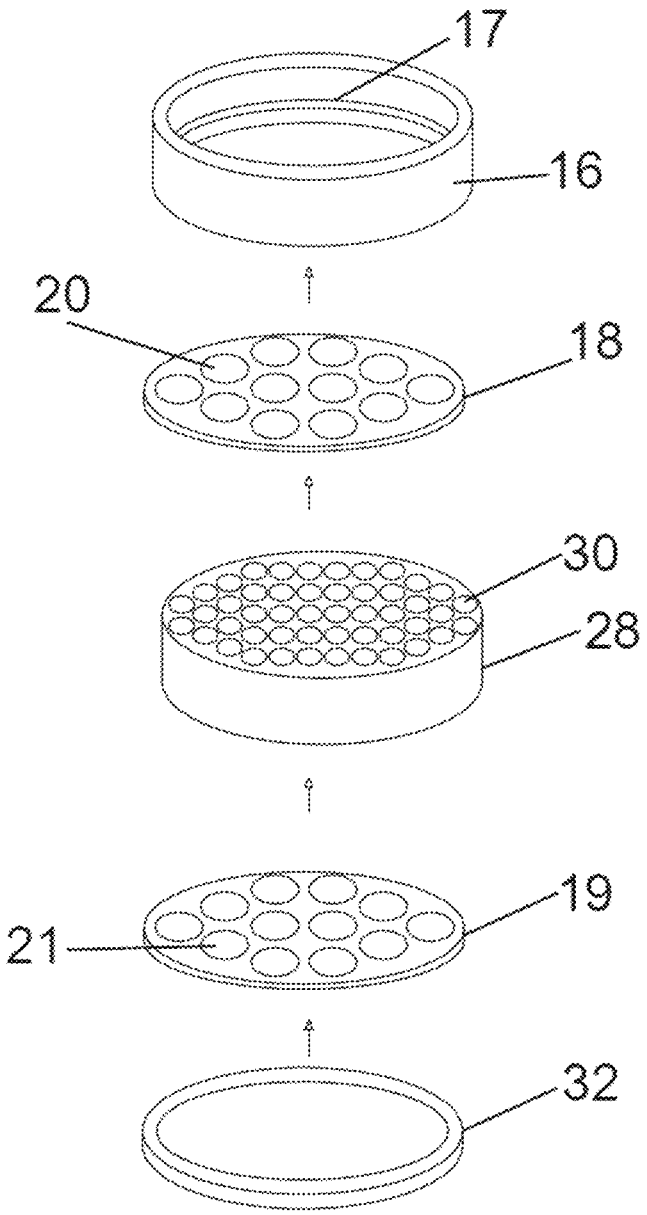
FIG. 5 is a perspective view of the separate components of the invention.
Figure 13A:
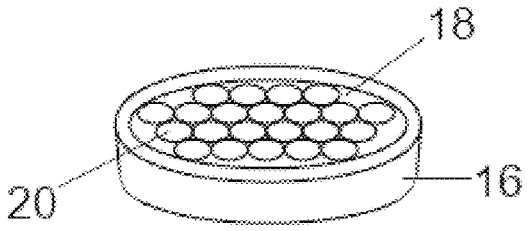
FIGS. 13A-13C show perspective views of different designs of an embodiment of the invention.
Figure 13B:
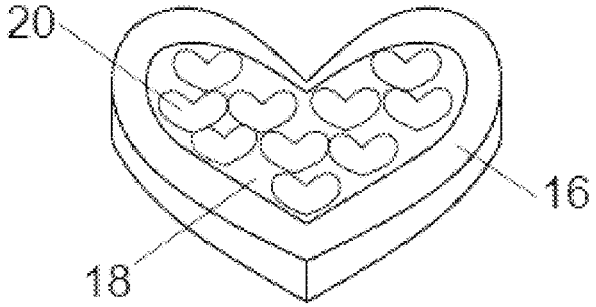
Figure 13C:
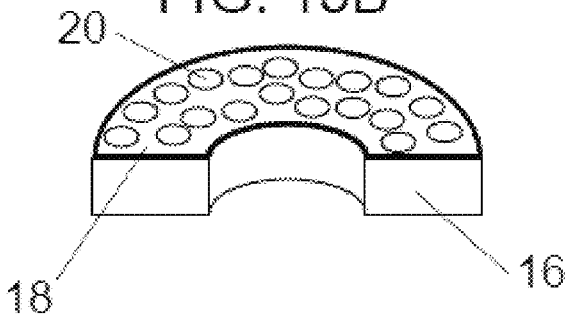

FIG. 5 shows how the components of the item (an upper grille 18, rubber 28, lower grille 19 and back plate 32) are layered together within wall 16. The wall 16 has an inner ledge 17 within which the upper grille 18 is placed securely to be held within the outer wall 16. In this embodiment, the upper grille 18 comprises a plurality of pre-determined openings 20 being circular in this instance, although, it is to be appreciated that the openings can be of a variety of shapes (FIGS. 13A-13C). The rubber material is inserted within the outer wall 16 below the upper grille 18. The layer of rubber material 28 is preferably between 3 mm-4 mm thick and contains pre-defined longitudinal holes 30 distributed throughout the layer which correspond to align with the openings 20 of the upper grille 18. Only one of these holes 30 is indicated in the figures. The rubber layer 28 is capable of receiving the barb part 25 of a pin 26 (FIGS. 1 and 9) which can insert the full way through the rubber until reaching the backing plate 32. The purpose of the rubber material is to receive the barbs of the adornments in such a way that the adornments can be secured in place in a manner in which it is easily removable. The additional backing plate 32 provides a closure disk upon which the tip of the barb 25 of the pin 26 of the adornment 22, rests, providing additional retention means.

In an additional embodiment, the jewellery item might also include a lower grille 19 which may have pre-determined openings 21 and which may be secured between rubber layer 28 and the backing plate 32. In this embodiment, essentially one rubber layer will be "sandwiched" between upper grille 18 and lower grille 19. In this embodiment adornments 22 can be inserted into either oppositely positioned upper grille 18 or lower grille 19.

In a further embodiment, the back plate 32 may itself be secured to the rubber layer 28. In a further embodiment, the back plate 32 may incorporate apertures of the kind shown in lower grille 19 in order to allow adornments 22 to be secured on either side of the item. Either the lower grille 19 or the backing plate 32 may be used in preferred embodiments to hold the rubber layer 28 in position. In certain embodiments when a lower grille 19 is provided with apertures 21, a portion of the adornments 22 may protrude under the lower grille 19. Other embodiments may also include an adhesive or an adhesive layer between upper grille 18 or lower grille 19 and the rubber layer 28.

In a further embodiment, there may be one or more small very low protrusions or tabs on the inside of the frame outer wall 16. These may be just above the final position required for the lower grille 19 (grille that is under the rubber in embodiment when a lower grille is used). These protrusions or tabs (not shown) may be on each inner face of the wall or spaced around the perimeter of the inside of the outer wall 16. When tabs are employed, they may stop the lower grille 19 from moving upwards and provide a bed to stop uneven positioning, compressing the rubber layer 28 or tilting of the grille or other unwanted movements. When it is assembled in manufacture, the upper grille 18 may advantageously have small matching cut out shapes on its edge removed to allow it to move past the protruding 'tabs' when it is being inserted into the open back of the frame of the jewellery item.

In a further embodiment where the upper grille 18 has a lower diameter or has an area of reduced dimensions when compared to the lower grille 19, the outer wall 16 may also have a smaller diameter or an area of reduced dimensions above the lower grille 19 so that the upper grille 18 may be tightly secured despite it itself having a smaller diameter than the lower grille 19. It will then be sufficient to only secure the lower grille 18 to the outer wall by fastening means such as a tab, a weld, a backing plate etc.

Figure 6A:
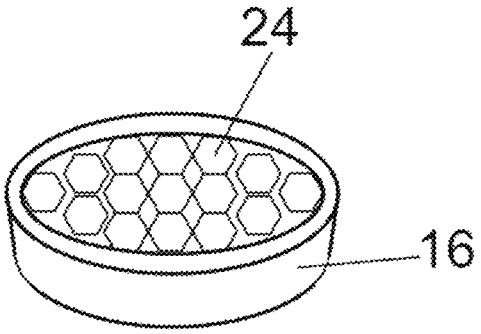
FIG. 6A is a perspective view of an embodiment of the invention.
Figure 6B:
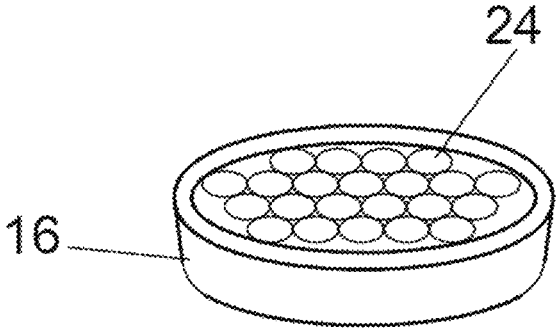
FIG. 6B is a perspective view of an embodiment of the invention.
Figure 7:
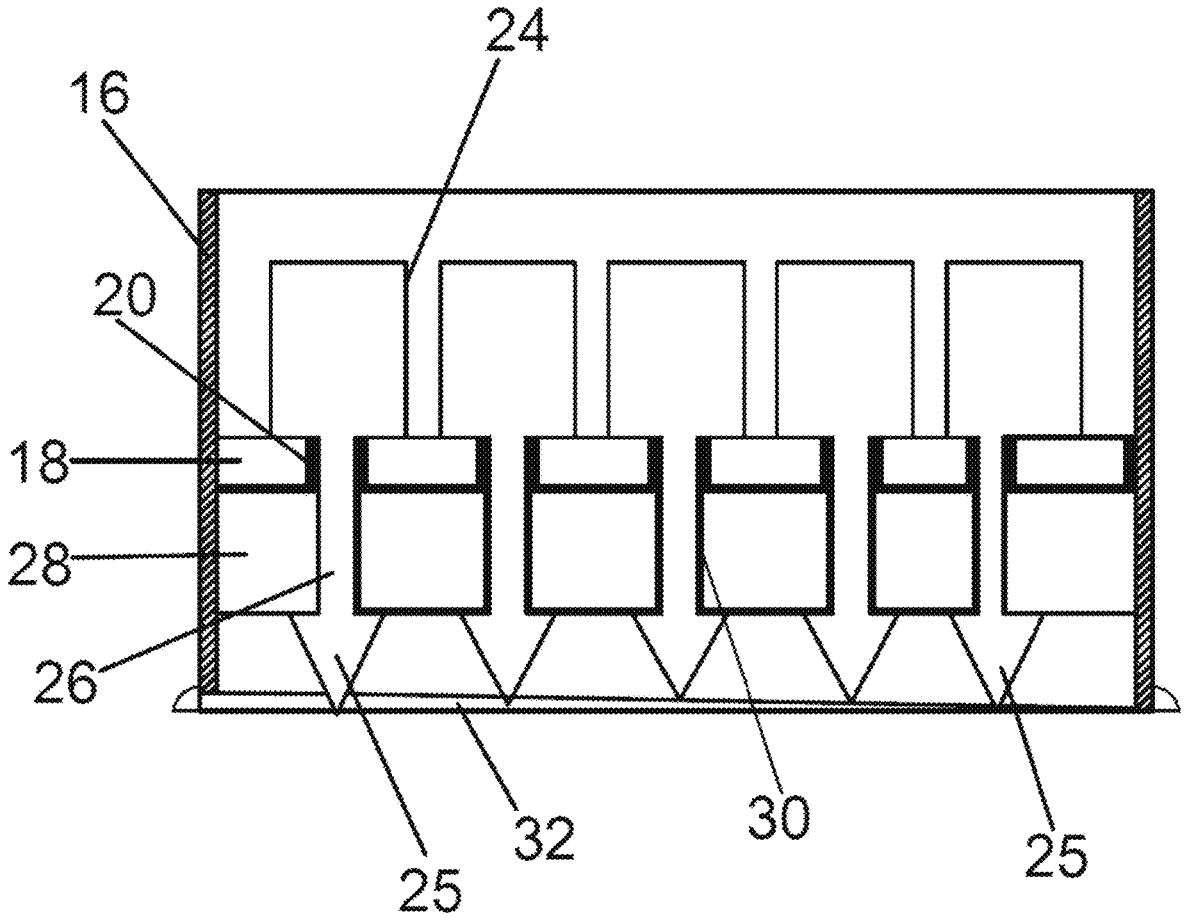
FIG. 7 is a cross-section, cut-away view of the embodiment in FIG. 6.
Figure 8:
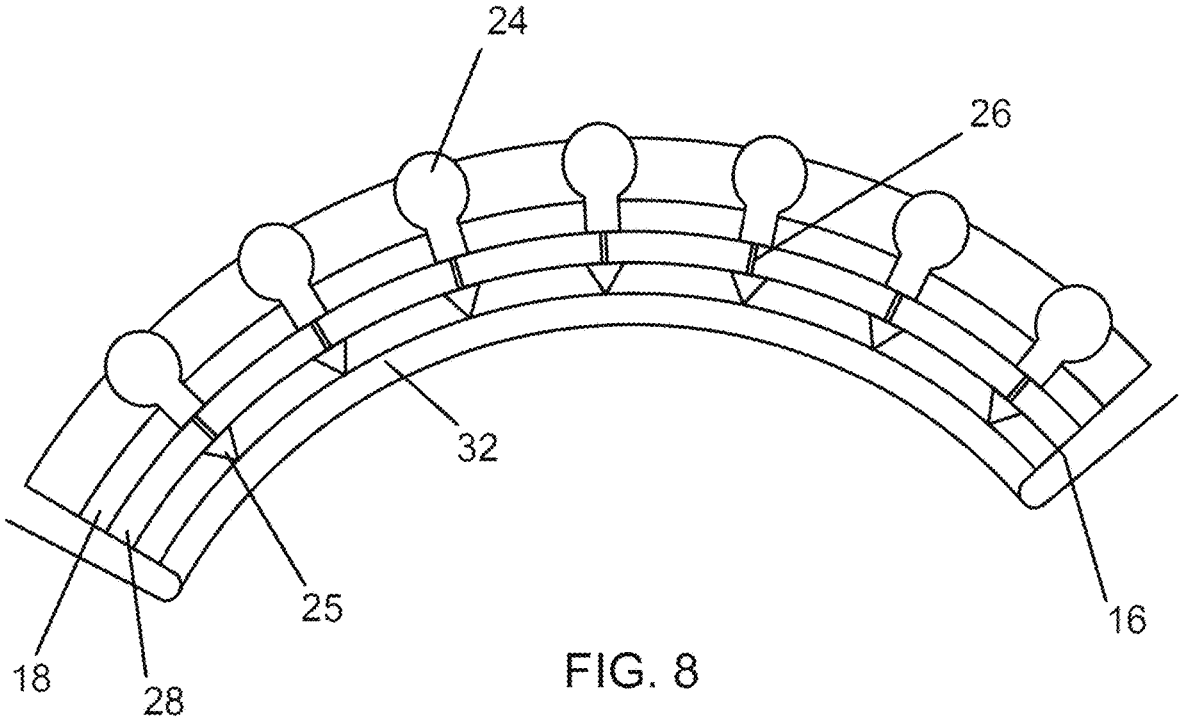
FIG. 8 is cross-section perspective view of a dome-shaped embodiment of the invention.
Figure 9A:
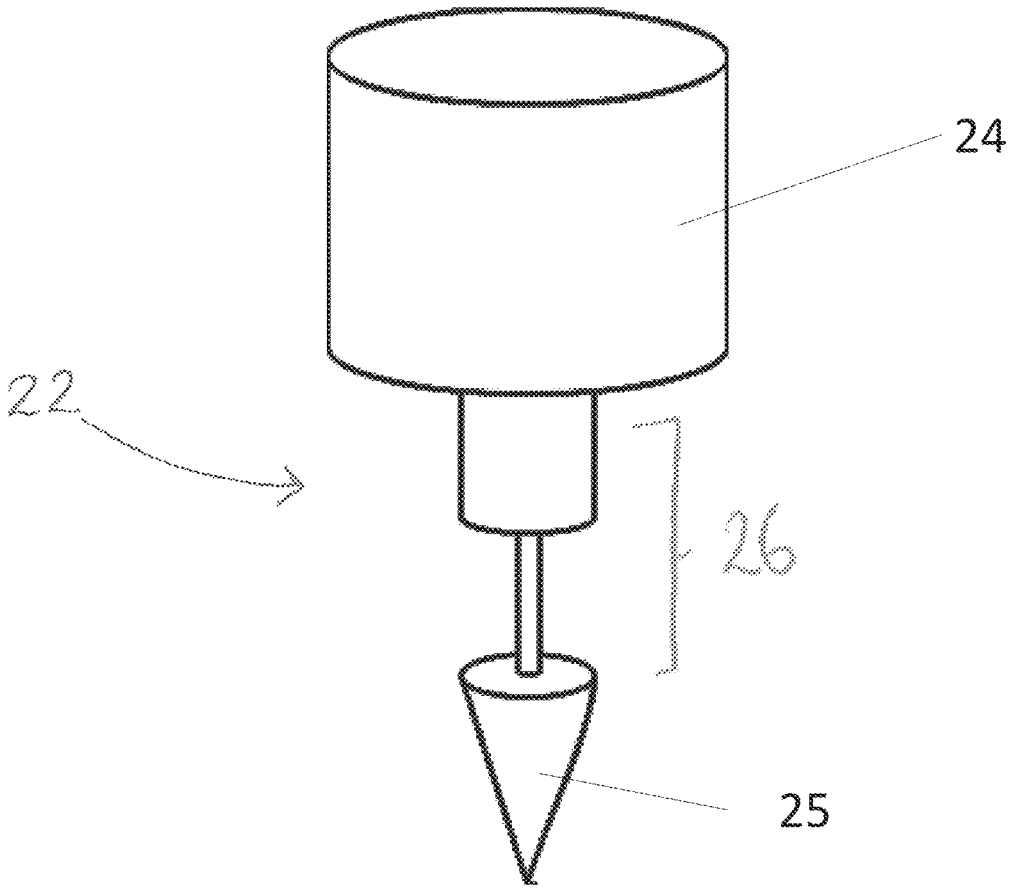
FIGS. 9A-9B show close-up perspective views of an embodiment of an adornment.
Figure 9B:
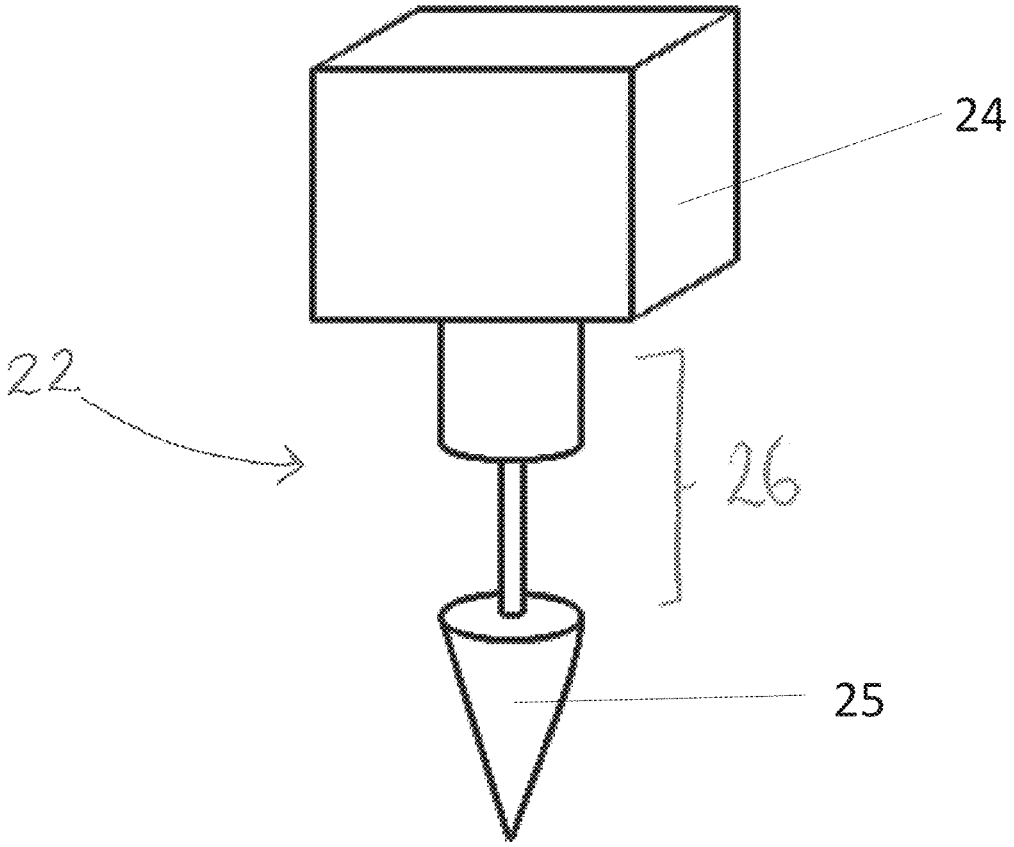
Figure 9C:
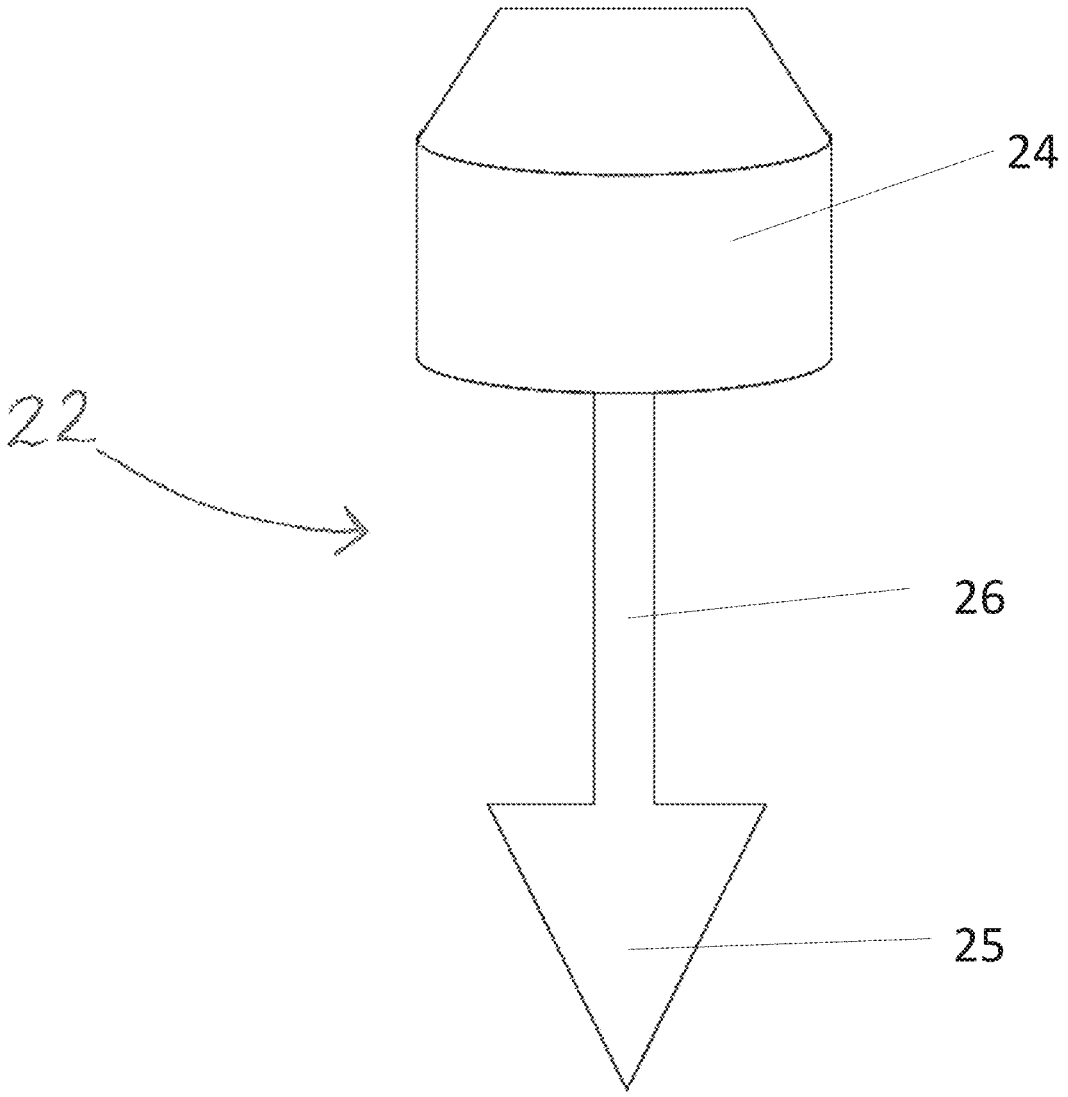
FIG. 9C shows a side view of an embodiment of an adornment.

When fully assembled, the components of FIG. 5 form a layered item as shown in FIGS. 6-8. FIG. 6 is a perspective view from the top of an upper grille 18 which has been filled with adornments 22. FIG. 7 shows a cross-sectional view of the adornments 22 as arranged in FIG. 6 within the upper grille 18. Here it can be clearly seen how the adornment 22 extends though both the upper grille 18 and the rubber layer 28. The decorative element 24 rests above the upper grille 18 within the wall 16. The barb 25 can be seen to have been inserted the full way through the rubber layer 28 with the pointed tip resting upon backing plate 32. The backing plate 32 prevents the barb from going further than necessary. The rubber layer 28 retains the adornment by means of friction.

The remainder of the pin 26 can be seen to extend fully through both the openings 20 in upper grille 18 and the holes 30 in the rubber layer 28.

FIG. 8 shows an alternative embodiment of the invention wherein the grille 18 itself is dome shaped. In this embodiment it is thought that the material will also be of a flexible variety. The adornments 22 are placed within the upper grille 18 in the same form as the previous embodiment in FIG. 7 with the pin 26 and barb 25 extending through the openings 20 in the upper grille and through holes 30 in the rubber 28 until reaching the backing plate 32. Each layer in this embodiment follows the curve of the dome of the upper grille 18.

A clear image of embodiments of an adornment 22 is shown in FIGS. 9A-9C. The adornment 22 comprises decorative element 24 attached to the pin 26. The pin 26 has a barb part 25 at the end of the shaft of the pin. The shaft has a region of greater diameter which corresponds preferably precisely to the size of the aperture 20 provided in the upper grille 18. The region of greater diameter also provides for a more robust structure suitable for withstanding insert and release from the item of jewellery. The decorative element 24 can be of any variety including precious gem stones, shaped stones, decorative jewels and any appropriate feature. The shaft of the pin 26 can be any cylindrical shape, as can the barb 25. FIG. 9C shows a simplified side-view of an embodiment of an adornment 22 where the pin 26 has a uniform circumference for the entire length and the decorative element 24 has a raised gem stone.

The barb 25 is to be releasably inserted into the upper grille 18, with the barb part 25 inserting fully into the rubber material layer 28 beneath, with the decorative element 24 of the adornment 22 remaining above the upper grille 18, still contained within outer wall 16.

Figure 10:
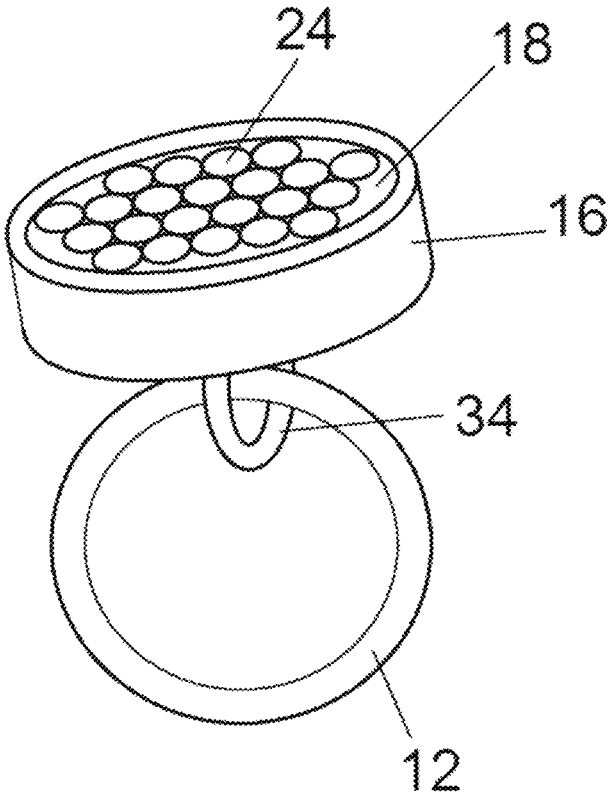
FIG. 10 is a perspective view of an item of jewellery according to an embodiment.
Figure 11:
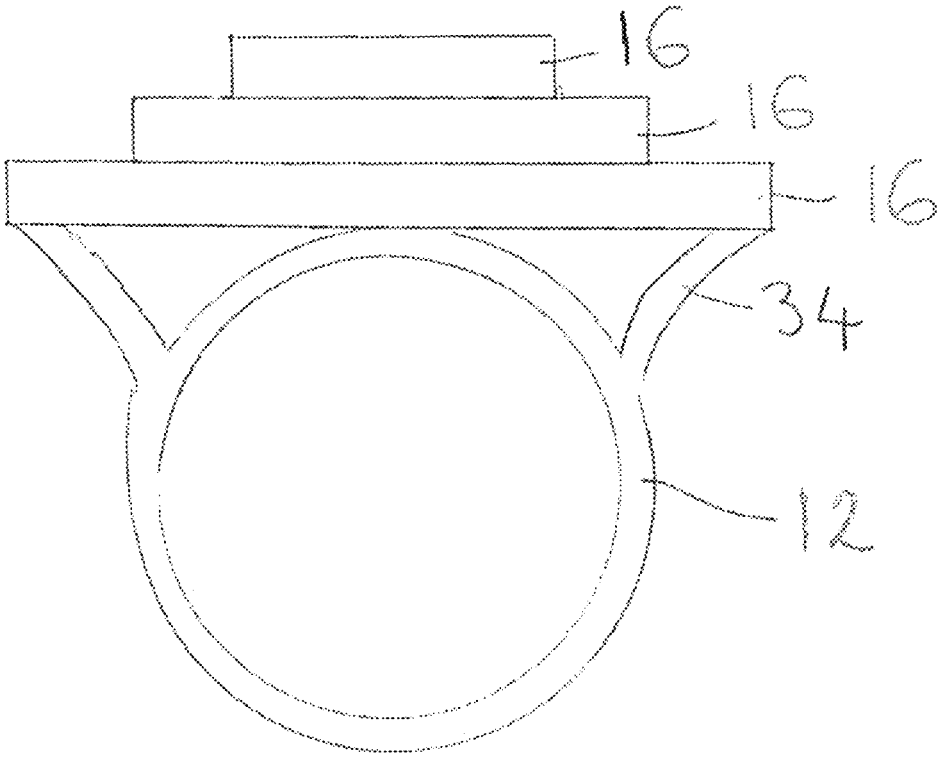
FIG. 11 is a side view of an alternative embodiment of the invention.

It is thought that the fully comprised item can be attached to an item of such as a ring or earring, by a suitable attachment means. FIG. 10 shows one embodiment in which the item is moulded to a ring by a looped welding 34. In alternative embodiments there could be attachment to a pendant, broach earring, necklace bracelet or any suitable item of jewellery. The attachment means in FIG. 10 is a loop 34 welded to the frame of the ring 12, however alternative attachment means such as a clasp, hook fastener or permanent attachment means is envisioned (FIG. 11).

In use, an owner of the piece of can obtain just one upper grille 18 and separate, multiple adornments 22 of their choosing of a variety to fit within the particular upper grille 18. The adornments 22 can be of a variety of decorative elements 24. An owner can releasably insert these adornments into the upper grille 18 to their own choice and timing. A professional jeweller is not required due to the ease and simplicity by which the adornments 22 can be inserted and removed because of the viscoelastic material of the rubber layer 28. The upper grille 18 can be either fully or partially filled with adornments 22 at any one time. To insert an adornment 22, the pin 26 of an adornment 22 is inserted through any of the openings 20 in the upper grille 18, barb—first, the entire way through the rubber layer 28 until the tip of the barb 25 reaches the backing plate 32. The rubber material 28 contains holes 30 of a number in excess of the number of openings 20 in the upper grille 18, to allow for differing positions and angles if desired. However, all the holes 30 can correspond and be aligned to openings 20. Once in place, the adornment 22 is secured by the rubber layer 28, outer wall 16 and backing plate 32. The wall 16 can either extend above the decorative element 24, as in FIG. 6 to provide extra protection to the decorative elements 24, or the decorative elements 24 can rest on the upper grille 18 extending above wall 16, as in FIG. 8. The alternative embodiments are envisioned to provide the user with a degree of choice.

To remove an adornment 22 and replace with another, the adornment 22 is simply gripped and lifted back through the rubber layer 28 and though the upper grille 18. This is possible due to the viscoelastic material and the opening. Removal of one adornment 22 allows for an alternative adornment to be put in its place or the opening 20 can remain unfilled. It is also envisioned that the rubber layer 28 can be replaced at any point in time if damage or rips occur, caused by the barb 25.

In an alternative embodiment the inner ledge 17 of wall 16 is a groove or indentation within which the upper grille 18 is inserted. In an alternative embodiment, a flange is included to increase the securement to retain the upper grille 18 in place. It is also to be appreciated that wall 16 can be of any 2D shape. For instance the shape of a semi-circle, a heart or a butterfly as shown in FIGS. 13A-13C respectively.

Figure 12:
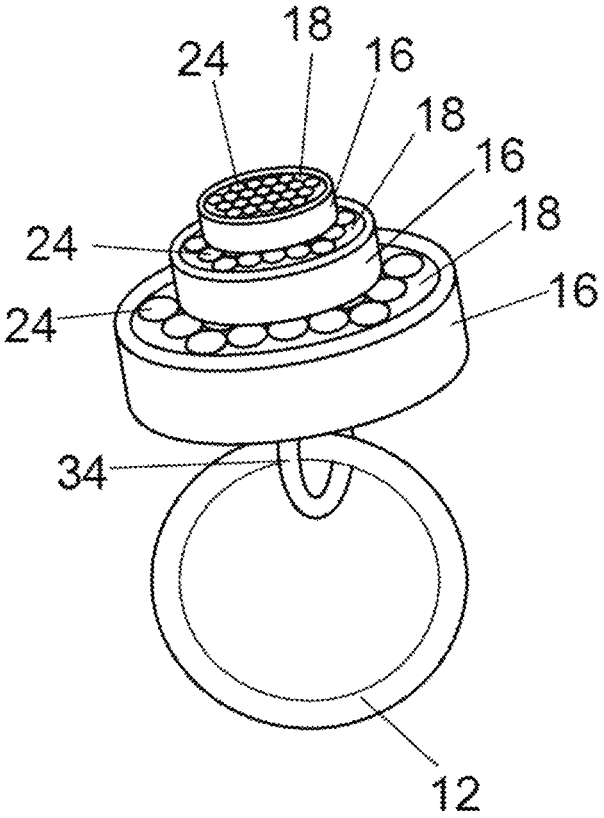
FIG. 12 is a perspective view of the embodiment of the invention in FIG. 11.

In a further alternative embodiment, there may be a plurality of upper grilles 18 which are located at different heights relative to the lower most extremity of the item. This embodiment can be seen in FIG. 11 and FIG. 12. In this embodiment, each layer has its own upper grille 18 and rubber layer 28. FIG. 11 shows this embodiment as a side view whereas FIG. 12 shows this embodiment in the form of a ring 12.

FIG. 13, as mentioned previously, shows alternative designs of both the wall 16 and of the upper grille 18 and openings 20. In these embodiments, the adornments 22 will be modified for a suitable fit.

In a further alternative embodiment, the rubber material 28 may be of any other suitable material including foam. In the preferred embodiment, the rubber layer is between 3-4 mm as aforementioned, however alternative embodiments are envisaged whereby the rubber layer is only 2 mm thick or less, particularly for embodiments where the openings 20 within the upper grille 18 are larger than 2.5 mm thick.

In a further embodiment, the adornments 22 could be inserted into a frame shaped around a pre-determined single row of openings 20 in order to create a line of adornments 22.

In a further embodiment, there may be provided a pair of parallel rows of openings.

In a further embodiment, the item may incorporate a grille which is part of a sphere, or a hollow shape with a thin sheet of metal with openings of the kind mentioned previously. The hollow formed then by the grille of this kind may be filled with rubber or another appropriate material in order to facilitate the receipt of adornments 22.

In a further embodiment, fastening means may be provided in any of the preceding embodiment to prevent the rubber layer 28 moving underneath the upper grille 18, moving laterally, and so the holes 30 in the rubber layer 28 do not line up with the openings 20 on the grille 18. In a preferred embodiment, one or more pegs extending downwards whilst being attached to underneath of the upper grille 18, preferably as part of the upper grille 18 may be incorporated. These may be integral to the upper grille 18 and may be made by metal casting. These may even be in predetermined holes in the rubber layer 28, or, upwards from the lower grille 19 instead as extending from the upper grille 18.

What is claimed is:

1. A customisable item of jewellery comprising:

a grid with a plurality of openings defining a plurality of distinct closely contiguous adornment locations;

an attachment means suitable for releasably retaining a pin of an adornment in each selected one of said plurality of openings;

whereby once a plurality of adornments are attached to said attachment means, a cluster of releasable adornments is formed;

wherein said attachment means comprises a layer of resilient material which is provided beneath said grid and which spans a plurality of said openings; and whereby said layer of resilient material is positioned to receive a pin of an adornment, the pin being retained by frictional contact between the pin and the resilient material when the pin is inserted into the resilient material; and an upstanding peripheral wall that substantially surrounds the grid where the plurality of adornment locations are provided.

2. An item according to claim 1, wherein said wall comprises a recessed channel located on the inside surface of said wall for receiving said grid.

3. An item according to claim 2, wherein said wall comprises one or more flanges for carrying said grid.

4. An item according to claim 1, further comprising a plurality of adornments which incorporate a head, and a pin projecting from said head for releasable attachment to said attachment means.

5. An item according to claim 4, wherein said pin comprises a barb.

6. An item according to claim 1, wherein the resilient material comprises a viscoelastic material.

7. An item according to claim 1, further comprising a plurality of grids which are located at different heights relative to the lower most extremity of the item.

8. An item according to claim 1, wherein said grid is domed.

* * * * *